US010543584B2

(12) United States Patent
Fukui et al.

(10) Patent No.: US 10,543,584 B2
(45) Date of Patent: Jan. 28, 2020

(54) CLAMP APPARATUS

(71) Applicant: SMC CORPORATION, Chiyoda-ku (JP)

(72) Inventors: Chiaki Fukui, Abiko (JP); Kazuyoshi Takahashi, Koto-ku (JP); Hideki Sasaki, Toride (JP); Masaharu Kobayashi, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 14/759,307

(22) PCT Filed: Dec. 11, 2013

(86) PCT No.: PCT/JP2013/083810
§ 371 (c)(1),
(2) Date: Jul. 6, 2015

(87) PCT Pub. No.: WO2014/115445
PCT Pub. Date: Jul. 31, 2014

(65) Prior Publication Data

US 2015/0352692 A1 Dec. 10, 2015

(30) Foreign Application Priority Data

Jan. 28, 2013 (JP) ..... 2013-013560

(51) Int. Cl.
*B25B 5/12* (2006.01)
*B25B 5/06* (2006.01)
*B25B 5/04* (2006.01)

(52) U.S. Cl.
CPC ..... *B25B 5/04* (2013.01); *B25B 5/064* (2013.01); *B25B 5/122* (2013.01)

(58) Field of Classification Search
None
See application file for complete search history.

(56) References Cited

U.S. PATENT DOCUMENTS 1,771,712 A 7/1930 Jimerson
2,341,602 A * 2/1944 Dewey ..... B21J 9/04 269/34

(Continued)

FOREIGN PATENT DOCUMENTS

CN 1277907 A 12/2000
CN 201415334 Y 3/2010

(Continued)

OTHER PUBLICATIONS

Combined Chinese Office Action and Search Report dated May 3, 2016 in Patent Application No. 201380071484.2 (with English language translation).

(Continued)

*Primary Examiner* — Joseph J Hail
*Assistant Examiner* — Brian D Keller
(74) *Attorney, Agent, or Firm* — Oblon, McClelland, Maier & Neustadt, L.L.P.

(57) ABSTRACT

A clamp apparatus is equipped with first and second clamp arms supported rotatably with respect to a body, and a drive unit having a pair of first and second pistons displaced under the supply of a pressure fluid. A driving force of the drive unit is transmitted to the first and second clamp arms through knuckle joints, which are connected to first and second piston rods, power-boost levers, and link arms. The power-boost levers are formed such that the length from a support pin toward the knuckle joint is longer than the length from the support pin toward the link arm.

6 Claims, 5 Drawing Sheets

(56) References Cited

U.S. PATENT DOCUMENTS

| | | | | |
|---|---|---|---|---|
| 3,743,345 | A * | 7/1973 | Eckman | B60P 3/341 135/117 |
| 4,362,261 | A * | 12/1982 | Cook, Jr. | B23K 20/12 228/2.1 |
| 6,378,856 | B1 | 4/2002 | Takahashi | |
| 8,286,955 | B2 * | 10/2012 | Damang | B23Q 1/76 269/165 |
| 2004/0113343 | A1 | 6/2004 | McIntosh et al. | |

FOREIGN PATENT DOCUMENTS

| | | |
|---|---|---|
| DE | 3031778 | 2/1982 |
| GB | 2 316 894 A | 3/1998 |
| JP | 4950123 B2 | 6/2012 |

OTHER PUBLICATIONS

International Search Report and Written Opinion dated Mar. 27, 2014 in PCT/JP2013/083810 filed Dec. 11, 2013.
Office Action dated May 30, 2018 in Mexican Patent Application No. MX/a/2015/009671 (with English language translation), 7 pages.
German Office Action dated Jul. 15, 2019 in German Patent Application No. 112013006237.2, 5 pages.

* cited by examiner

A
B
C
D
18
42
44
48
52
55
57
58
100
102
104
106
108
110
112
84
86
36
38

CLAMP APPARATUS

TECHNICAL FIELD

The present invention relates to a clamp apparatus for clamping a workpiece on an automated assembly line or the like.

BACKGROUND ART

Heretofore, for example, in an automated assembly line for automobiles, an assembly process has been carried out in which clamping is performed by a clamp apparatus under a condition in which pre-formed frames are positioned in an overlaid manner and the frames are welded together.

As one clamp apparatus of this type, for example, as disclosed in Japanese Patent No. 4950123, the clamp apparatus comprises a pair of clamp arms, the clamp arms being disposed on left and right sides, respectively, and the clamp arms are disposed rotatably through respective pins. Proximal ends of the clamp arms are supported pivotally through a base that is connected to a drive unit, such that distal ends of the clamp arms can be operated to open and close. A workpiece such as a frame or the like can be gripped from left and right sides thereof by the distal ends of the pair of clamp arms.

SUMMARY OF INVENTION

However, with the aforementioned clamp apparatus, from an initial condition in which clamping of a workpiece is started by the clamp arms to a clamped condition in which the workpiece is clamped completely, the clamping force changes in a gradually increasing manner, and as a result, the clamping force applied with respect to the workpiece tends to be unstable. Thus, there has been a demand in the art for a clamp apparatus which enables a workpiece to be clamped with a stable clamping force across the entire range of clamping from an initial state in which clamping of the workpiece is started up to a fully clamped state in which the workpiece is clamped completely.

A general object of the present invention is to provide a clamp apparatus having a simple structure, which enables a workpiece to be clamped stably with a substantially constant clamping force over an entire range of clamping from an initial state in which clamping of the workpiece is started up to a fully clamped state in which the workpiece is clamped completely, while also allowing the apparatus to be made smaller in scale.

The present invention provides a clamp apparatus for rotating a pair of clamp arms and thereby clamping a workpiece between the clamp arms, comprising:

a body;

a drive unit disposed on the body and including displaceable members that are displaceable along an axial direction;

the pair of clamp arms supported rotatably with respect to the body, the clamp arms being disposed in confronting relation to each other; and a driving force transmission mechanism including transmission levers for connecting ends of the displaceable members with ends of the clamp arms, and which transmits a driving force along the axial direction of the drive unit to the clamp arms through the transmission levers, for thereby rotating the clamp arms, wherein the transmission levers are supported rotatably with respect to the body, one end of each of the transmission levers being connected to one of the displaceable members, and another end thereof being connected to one of the clamp arms, such that a distance in a longitudinal direction from a supported location with respect to the body to the one end is longer than a distance in the longitudinal direction from the supported location to the other end.

According to the present invention, in the driving force transmission mechanism that makes up the clamp apparatus, the transmission levers are provided, which are connected to ends of the displaceable members in the drive unit, and to ends of the clamp arms, and the transmission levers are supported rotatably with respect to the body. Further, a distance in a longitudinal direction from one end of each of the transmission levers to the supported location thereof on the body is set to be longer than a distance in the longitudinal direction from the supported location to the other end thereof that is connected to the clamp arm.

The transmission lever is formed such that the length of the one end side with respect to the supported location of the transmission lever is longer than the length of the other end side with respect to the supported location. Thus, when by displacement of the displaceable members under a driving action of the drive unit, a driving force is transmitted to the ends of the clamp arms through the transmission levers, and the clamp arms are rotated to clamp a workpiece, the driving force is boosted by an amount corresponding to the length ratio, and then transmitted to the clamp arms.

Accordingly, even if the driving force output from the drive unit is small, by boosting the driving force with the transmission levers, the workpiece can be clamped at a desired clamping force. Further, the drive unit can be made smaller in scale, thereby enabling a reduction in the size of the clamp apparatus.

The above and other objects, features and advantages of the present invention will become more apparent from the following description when taken in conjunction with the accompanying drawings in which preferred embodiments of the present invention are shown by way of illustrative example.

DESCRIPTION OF EMBODIMENTS

Figure 1:
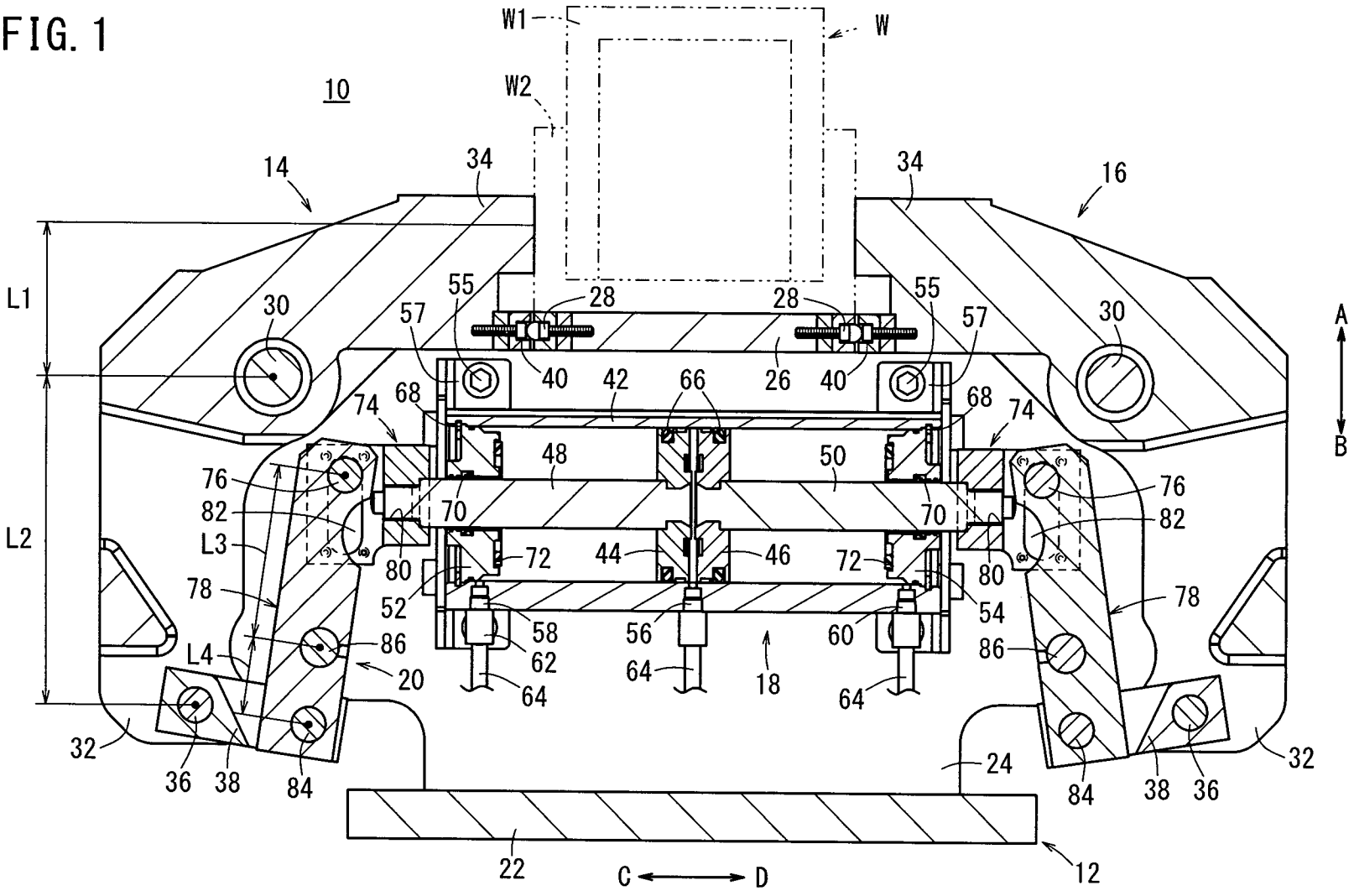
FIG. 1 is an overall cross sectional view of a clamp apparatus according to an embodiment of the present invention.
Figure 2:
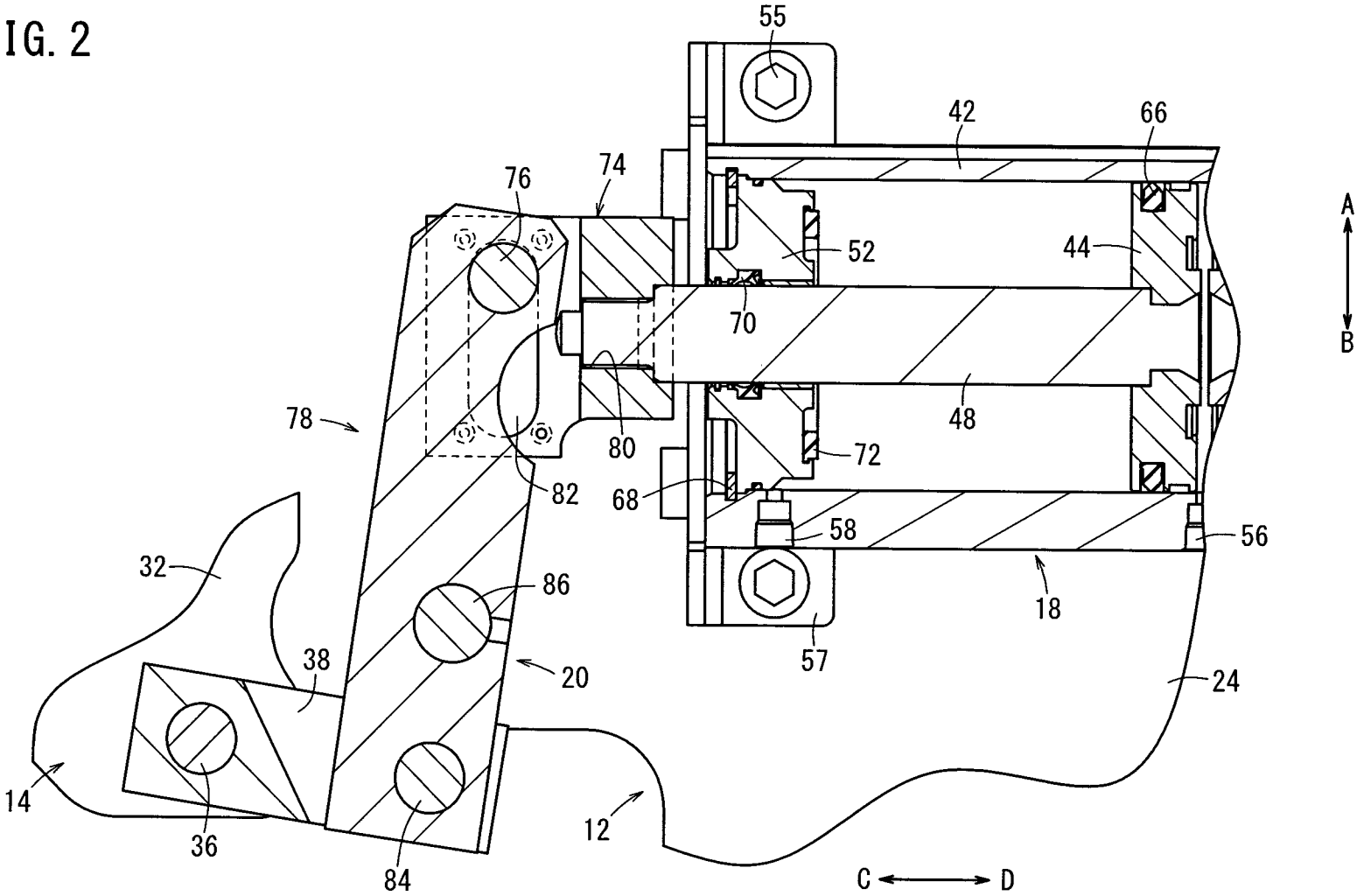
FIG. 2 is an enlarged cross sectional view in the vicinity of a driving force transmission mechanism in the clamp apparatus of FIG. 1.
Figure 3:
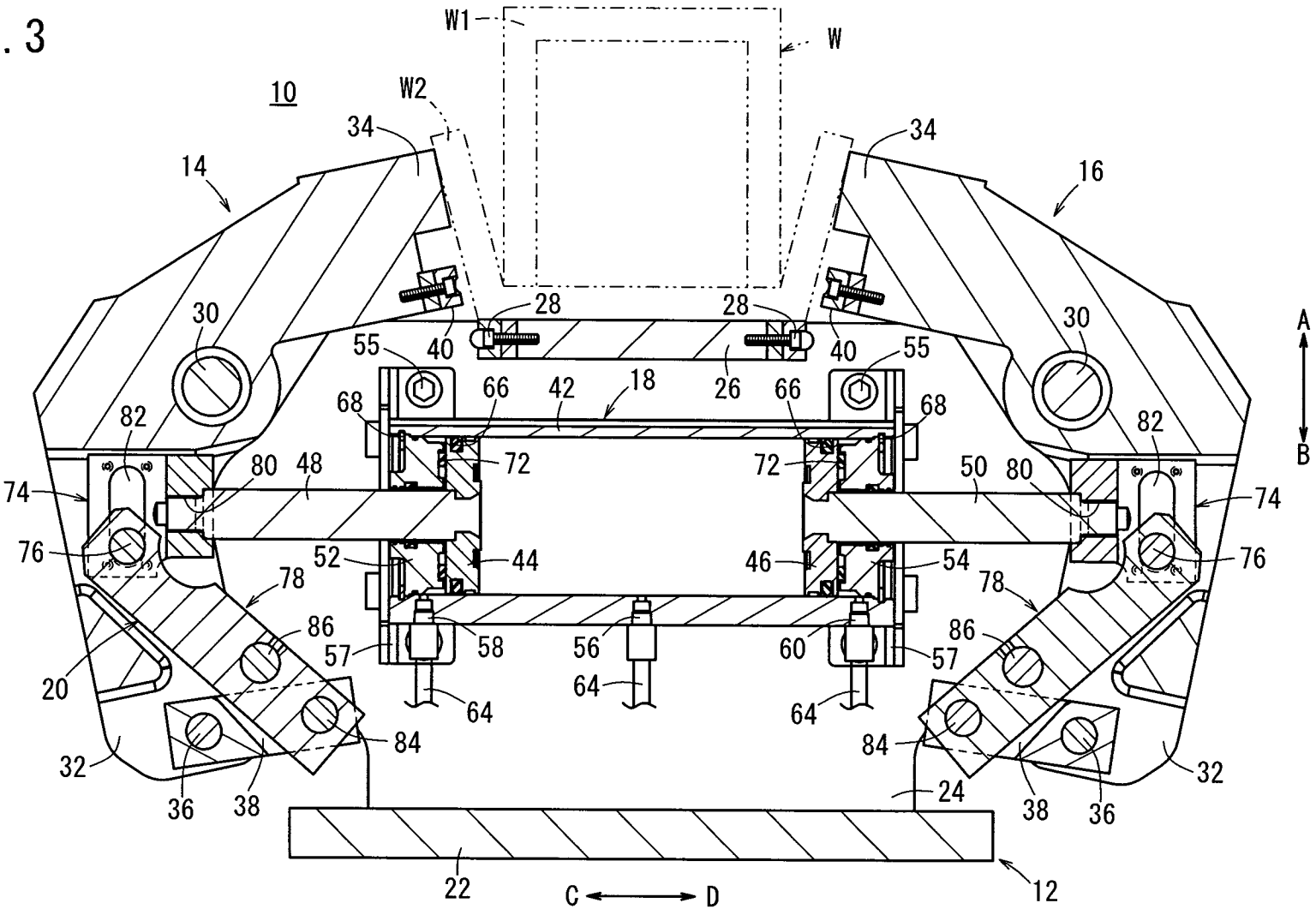
FIG. 3 is an overall cross sectional view of the clamp apparatus of FIG. 1 in an unclamped condition.

As shown in FIGS. 1 through 3, a clamp apparatus 10 includes a body 12, a pair of first and second clamp arms 14, 16, which are pivotally supported rotatably with respect to the body 12, a drive unit 18 fixed to the body 12, and a driving force transmission mechanism 20 that transmits a driving force of the drive unit 18 to the first and second clamp arms 14, 16.

The body 12 is constituted from a plate-shaped base 22, which is arranged horizontally, and a pair of plate members 24, which are separated mutually by a predetermined distance, and are connected respectively to opposite side surfaces of the base 22. The plate members 24 are disposed perpendicularly with respect to the base 22, and are formed with a predetermined height in an upward direction (the direction of the arrow A). Further, the base 22 is arranged, for example, on a floor surface or the like, and the clamp apparatus 10 is fixed in place by securing the base 22 using non-illustrated bolts or the like.

Further, on an upper part of the body 12, a ceiling portion 26 is disposed, which is connected to ends of the pair of plate members 24. The ceiling portion 26 is arranged perpendicularly with respect to the direction of extension (the direction of arrows A and B) of the plate members 24, and is arranged substantially centrally in the widthwise direction (the direction of arrows C and D) in the body 12. More specifically, the ceiling portion 26 is disposed substantially in parallel with the base 22. On the ceiling portion 26, receiving grooves 28 are formed respectively on side surfaces in confronting relation to the later-described first and second clamp arms 14, 16, and when a workpiece W is gripped by the clamp apparatus 10, the workpiece W is arranged on the upper surface of the ceiling portion 26.

The first and second clamp arms 14, 16 are formed substantially in the same shape, and are arranged mutually and symmetrically about the drive unit 18, and further are disposed between one of the plate members 24 and the other of the plate members 24. Additionally, the first and second clamp arms 14, 16 are supported rotatably on the body 12 through arm pins (support shafts) 30, which are inserted through the first and second clamp arms 14, 16 substantially centrally in the longitudinal direction thereof.

The first and second clamp arms 14, 16 are L-shaped in cross-section, with bifurcated yoke portions 32 being formed on ends, i.e., one end side, thereof that are arranged on the side of the base 22 (in the direction of the arrow B), and gripping portions 34 for clamping the workpiece W being formed, respectively, on other ends, which are bent substantially perpendicularly with respect to the one end side.

Ends of link arms 38 are pivotally supported via first link pins 36 on ends of the yoke portions 32.

The gripping portions 34 are formed, for example, with substantially rectangular shapes in cross section, and mutually confronting gripping surfaces thereof are formed as vertical surfaces substantially parallel with the longitudinal direction of the first and second clamp arms 14, 16.

Further, the arm pins 30 are inserted in the first and second clamp arms 14, 16, respectively, through holes thereof at locations where the other end sides are bent with respect to the one end sides. Both ends of the arm pins 30 are supported by the pair of plate members 24, and the first and second clamp arms 14, 16 are pivotally supported for rotation about the arm pins 30. Below the gripping portions 34, positioning portions 40 are formed, respectively, which project with respect to the gripping surfaces of the gripping portions 34. At a time of clamping when the first and second clamp arms 14, 16 are made to approach each other and grip the workpiece W, the positioning portions 40 are brought into engagement, respectively, with the receiving grooves 28 of the ceiling portion 26.

In the first and second clamp arms 14, 16, as shown in FIG. 1, a first distance L1 from the arm pin 30 to the center of the gripping region of the workpiece W on the gripping portion 34, and a second distance L2 from the arm pin 30 to the first link pin 36 are set such that the ratio between L1 and L2 is equal to a predetermined ratio (length ratio), and the second distance L2 is set to be greater than the first distance L1 (L1<L2).

The drive unit 18 is arranged between the pair of plate members 24, and is disposed horizontally and separated a predetermined distance with respect to the base 22. The drive unit 18 comprises a fluid pressure cylinder including a cylindrical cylinder tube (cylinder main body) 42, a pair of first and second pistons (displaceable members) 44, 46 disposed displaceably in the interior of the cylinder tube 42, first and second piston rods (displaceable members) 48, 50, which are connected respectively to the first and second pistons 44, 46, and first and second rod covers 52, 54 disposed on respective opposite ends of the cylinder tube 42, and which displaceably support the first and second piston rods 48, 50, respectively.

Both end portions of the cylinder tube 42 are fixed to the plate member 24 by fixing bolts 57 through attachment brackets 55. In addition, first through third ports 56, 58, 60, which penetrate in directions perpendicular to the axial direction (indicated by arrows A, B) of the cylinder tube 42, are formed in a side surface of the cylinder tube 42. Communications between the exterior and the interior of the cylinder tube 42 is enabled through the first through third ports 56, 58, 60.

The first port 56 is disposed centrally in the axial direction (the direction of arrows C and D) of the cylinder tube 42, the second port 58 is disposed in the vicinity of one end of the cylinder tube 42 on the side (in the direction of the arrow C) of the first clamp arm 14, and the third port 60 is disposed in the vicinity of the other end of the cylinder tube 42 on the side (in the direction of the arrow D) of the second clamp arm 16. More specifically, the first through third ports 56, 58, 60 are separated from each other mutually in the axial direction (the direction of arrows C and D) of the cylinder tube 42.

In addition, tubes 64, which are connected to a non-illustrated pressure fluid supply source, are connected to the first through third ports 56, 58, 60 through respective couplings 62. Pressure fluid is supplied selectively either to the first port 56 or to the second and third ports (which may be collectively referred to as second ports) 58, 60 under a switching action of a non-illustrated switching device. The tubes 64 are connected to the second and third ports 58, 60 so as to be capable of supplying pressure fluid simultaneously thereto.

The first and second pistons 44, 46 are disk shaped, for example, with piston packings 66 being installed through annular grooves on the outer circumferential surfaces thereof. By sliding contact of the piston packings 66 with the inner wall surface of the cylinder tube 42, leakage of pressure fluid between the cylinder tube 42 and the first and second pistons 44, 46 is prevented.

Additionally, the first piston 44 is arranged on one end side (in the direction of the arrow C) from the center along the axial direction of the cylinder tube 42, and the second piston 46 is arranged on the other end side (in the direction of the arrow D) from the center of the cylinder tube 42. More specifically, the first piston 44 and the second piston 46 are disposed in parallel in the interior of the cylinder tube 42, and are arranged at positions separated by the same distance respectively from the one end and the other end of the cylinder tube 42.

Ends of the first and second piston rods 48, 50 are inserted respectively through the centers of the first and second pistons 44, 46 and are connected integrally to the first and second pistons 44, 46 by crimping. Other ends of the first and second piston rods 48, 50 are inserted through the first and second rod covers 52, 54, and project respectively to the exterior from the one end and the other end of the cylinder tube 42. Stated otherwise, the first piston rod 48 and the second piston rod 50 extend mutually in directions away from each other.

After insertion of the first and second rod covers 52, 54 into the cylinder tube 42, the first and second rod covers 52, 54 are locked by locking rings 68, which are placed in engagement with the inner circumferential surface of the cylinder tube 42. By sliding contact of rod packings 70, which are installed on inner circumferential surfaces of the first and second rod covers 52, 54, with outer circumferential surfaces of the first and second piston rods 48, 50, leakage of pressure fluid is prevented between the first and second piston rods 48, 50 and the first and second rod covers 52, 54.

Further, on the first and second rod covers 52, 54, annular dampers 72 are provided on end surfaces thereof that face toward the first and second pistons 44, 46, and the dampers 72 project outward slightly from the end surfaces of the first and second rod covers 52, 54. When the first and second pistons 44, 46 are displaced toward the first and second rod covers 52, 54, respectively, the first and second pistons 44, 46 come into abutment against the dampers 72, which are made from an elastic material such as rubber or the like, whereby shocks caused by the abutment are buffered.

The driving force transmission mechanism 20 includes a pair of knuckle joints (joint members) 74, which are connected to other ends of the first and second piston rods 48, 50, a pair of power-boost levers (transmission levers) 78 pivotally supported by second link pins 76 with respect to the knuckle joints 74, and a pair of the link arms 38 pivotally supported between the power-boost levers 78 and ends of the first and second clamp arms 14, 16.

The knuckle joints 74 are formed in block-like shapes, and include screw holes 80 in which the first and second piston rods 48, 50 are screw-engaged, and link grooves 82 through which the second link pins 76 are inserted. The link grooves 82 have oval shapes that extend along a vertical direction (the direction of arrows A and B) perpendicular to the direction of extension of the screw holes 80.

Further, the regions of the knuckle joints 74 including the link grooves 82 are each formed with a bifurcated or forked shape, with one end of each of the power-boost levers 78 being inserted therein.

In addition, by screw-engagement of the other ends of the first and second piston rods 48, 50 with respect to the screw holes 80 of the knuckle joints 74, respectively, the knuckle joints 74 are displaced together with the first and second piston rods 48, 50 in directions to approach and separate away from the cylinder tube 42.

The power-boost levers 78 are each formed into a plate-like shape having a predetermined length in the longitudinal direction. A second link pin (pin) 76 is pivotally supported on one end of each of the power-boost levers 78, and the second link pin 76 is inserted in the link groove 82 of each of the knuckle joints 74, whereby the power-boost levers 78 are supported rotatably with respect to the knuckle joints 74.

Further, third link pins 84 are inserted through other ends of the power-boost levers 78, so as to connect the other ends to ends of the link arms 38 through the third link pins 84. Consequently, the other ends of the power-boost levers 78 are supported for rotation relatively with respect to the link arms 38.

Furthermore, support pins 86 are inserted through holes in the power-boost levers 78, at a position between the one end and the other end thereof, the support pins 86 being supported by the pair of plate members 24. Owing thereto, the power-boost levers 78 are disposed rotatably about the support pins 86, which act as fulcrums for the power-boost levers 78.

In the power-boost levers 78, as shown in FIG. 1, a third distance L3 along the longitudinal direction of the power-boost lever 78 from the support pin 86 to the second link pin 76, and a fourth distance L4 along the longitudinal direction from the support pin 86 to the third link pin 84 are set such that the ratio between L3 and L4 is equal to a predetermined ratio (length ratio), and the third distance L3 is set to be greater than the fourth distance L4 (L3>L4).

In addition, ends on one side of the power-boost levers 78 are pressed, via the knuckle joints 74, by driving forces of the first and second piston rods 48, 50 of the drive unit 18, whereby the power-boost levers 78 are rotated about the support pins 86. Stated otherwise, linear displacement of the drive unit 18 is converted into rotational displacement of the power-boost levers 78.

The ends of the link arms 38 are supported pivotally by the first link pins 36 that are disposed on the first and second clamp arms 14, 16, whereas the other ends thereof are supported pivotally by the third link pins 84 supported on the power-boost levers 78. More specifically, the link arms 38 connect the power-boost levers 78 with the ends of the first and second clamp arms 14, 16, together with being disposed rotatably with respect to the first and second clamp arms 14, 16 and the power-boost levers 78. Therefore, the driving force transmitted to the power-boost levers 78 is transmitted to the first and second clamp arms 14, 16 to effect rotation thereof.

The clamp apparatus 10 according to the embodiment of the present invention is basically constructed as described above. Next, operations and advantages of the clamp apparatus 10 will be described. In the following description, the unclamped condition shown in FIG. 3, in which the gripping portions 34 of the first and second clamp arms 14, 16 are separated mutually, will be referred to as an initial position.

Figure 4A:
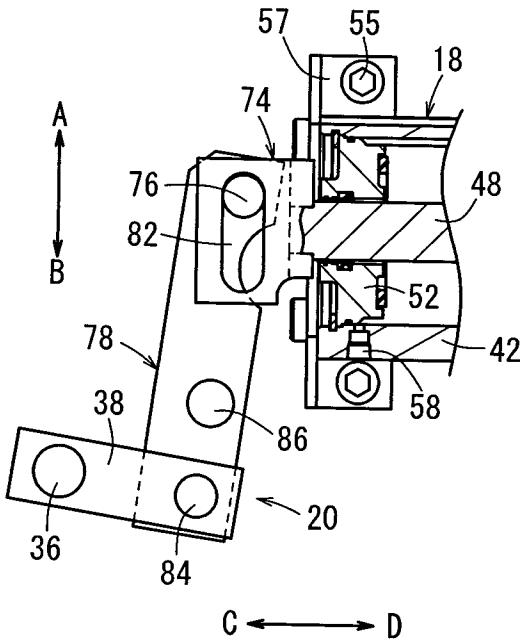
FIGS. 4A through 4C are operational views for describing operations of the driving force transmission mechanism.
Figure 4B:
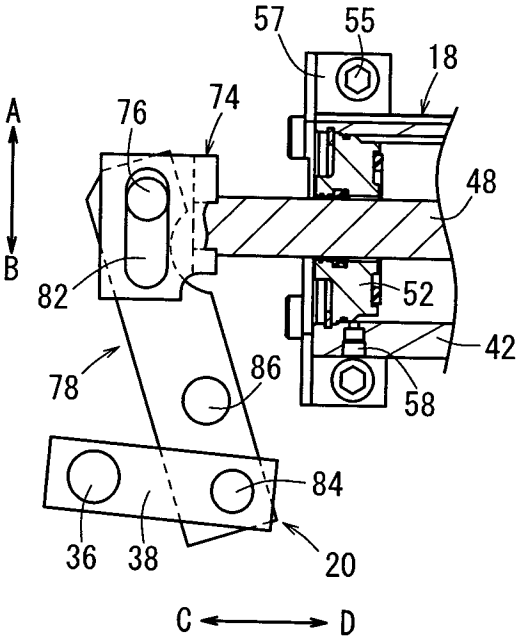
Figure 4C:
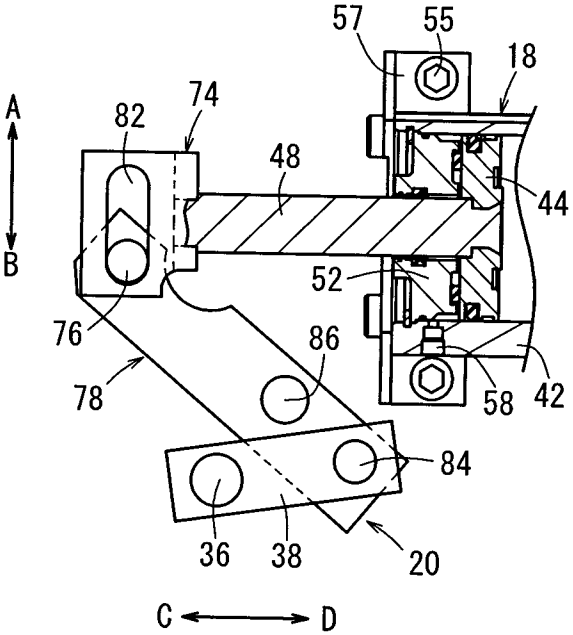

In the initial position, pressure fluid is supplied through the first port 56 between the first piston 44 and the second piston 46, whereby the first piston 44 and the second piston 46 are displaced by the pressure fluid in directions to separate away from each other, respectively, toward the first rod cover 52 (in the direction of the arrow C) and toward the second rod cover 54 (in the direction of the arrow D), and as shown in FIG. 4C, the second link pins 76 of the power-boost levers 78 assume a condition of being positioned downwardly in the link grooves 82.

A description will now be given concerning the workpiece W, which is gripped by the above-described clamp apparatus 10. For example, as shown in FIGS. 1 and 3, the workpiece W is made up from a first frame W1, which is U-shaped in cross section, and a second frame W2, which is U-shaped in cross section and is assembled together with the first frame W1 to thereby constitute a vehicle frame.

The first frame W1 is placed between the gripping portions 34 of the first and second clamp arms 14, 16 with the opening thereof oriented downward (in the direction of the arrow B), whereas the second frame W2 is mounted on the ceiling portion 26 with the opening thereof oriented upward (in the direction of the arrow A), and with the side walls thereof inclined such that the distance between the side walls gradually widens toward the side of the opening, and with the first frame W1 being inserted in the interior of the second frame W2.

Stated otherwise, the second frame W2 is arranged on an outer side with respect to the first frame W1, and the side walls of the second frame W2 are inclined so as to widen toward the first and second clamp arms 14, 16.

In this state where the workpiece W is set in a predetermined position on the clamp apparatus 10, first, under switching operation of the non-illustrated switching device, the pressure fluid that was supplied to the first port 56 instead is supplied simultaneously to the second and third ports 58, 60. At this time, supply of pressure fluid is carried out such that the amount of pressure fluid supplied with respect to the second and third ports 58, 60 is the same.

Accordingly, as shown in FIG. 1, by the pressure fluid that is introduced into the cylinder tube 42, the first and second pistons 44, 46 are pressed in directions to mutually approach one another, and the first and second piston rods 48, 50 and the knuckle joints 74 are displaced integrally together with the first and second pistons 44, 46.

In addition, by displacement of the knuckle joints 74 toward the cylinder tube 42, as shown in FIG. 4B, the second link pins 76, which are inserted through the link grooves 82, are moved upwardly (in the direction of the arrow A), and accordingly the ends of the power-boost levers 78 are pulled respectively toward the cylinder tube 42. Further, by rotation of the power-boost levers 78 about the support pins 86, the link arms 38, which are connected to the other ends of the power-boost levers 78, are pressed respectively in directions to separate away from the drive unit 18.

As a result, the ends of the first and second clamp arms 14, 16 are pressed by the link arms 38 in directions to separate mutually away from each other, whereby the gripping portions 34 on the other ends of the first and second clamp arms 14, 16 start to rotate about the arm pins 30 in directions to approach one another.

Furthermore, as shown in FIGS. 1 and 4A, by supply of pressure fluid to the drive unit 18, the knuckle joints 74 are pulled via the first and second piston rods 48, 50 toward the cylinder tube 42. Further, the power-boost levers 78 are rotated by movement of the second link pins 76 further upward along the link grooves 82, and via the power-boost levers 78 and the link arms 38, the lower ends of the first and second clamp arms 14, 16 are pressed in directions away from each other.

As a result, the gripping portions 34 of the first and second clamp arms 14, 16 are rotated mutually in directions to approach one another, and the side walls of the second frame W2 are pressed and deformed by the gripping portions 34 so as to approach each other mutually, whereby the side walls of the second frame W2 abut against the side walls of the first frame W1, and the side walls of the first and second frames W1, W2 become substantially parallel to each other. Thus, a clamped state in which clamping is completed is brought about (see FIG. 1).

At this time, the positioning portions 40 are engaged respectively with the receiving grooves 28 of the body 12, so that during clamping, the first and second clamp arms 14, 16 are positioned at predetermined stop positions, and further rotation of the first and second clamp arms 14, 16 is prohibited.

In addition, in a condition in which the first and second frames W1, W2 are clamped by the first and second clamp arms 14, 16, the side walls of the first and second frames W1, W2 are welded to each other by a non-illustrating welding apparatus, for example.

Further, each of the power-boost levers 78 is formed such that the length (third distance L3) from the support pin 86 toward the one end side thereof connected to the knuckle joint 74 is longer than the length (fourth distance L4) from the support pin 86 toward the other end side thereof connected to the third link pin 84. Consequently, when the workpiece W is clamped by the first and second clamp arms 14, 16, the driving force of the drive unit 18 is boosted in power by the length ratio (L3/L4) between the third distance L3 and the fourth distance L4, and the increased driving force is transmitted to the link arms 38.

Furthermore, each of the first and second clamp arms 14, 16 is formed such that the length (second distance L2) from the arm pin 30 toward the one end side thereof is longer than the length (first distance L1) from the arm pin 30 toward the other end side thereof. Thus, the driving force transmitted from the link arms 38 to the first and second clamp arms 14, 16 is boosted in power by the length ratio (L2/L1) between the first distance L1 and the second distance L2, whereby the workpiece W can be gripped with the thus-increased clamping force.

More specifically, since the driving force output from the drive unit 18 is boosted by the power-boost levers 78 and the first and second clamp arms 14, 16, and the workpiece W can be clamped thereby, it is unnecessary for a large scale drive unit 18 to be provided in order to obtain a predetermined clamping force, and substantially the same clamping force can be obtained by a small scale drive unit 18.

Further, by rotating the power-boost levers 78 and the link arms 38 via the knuckle joints 74 under the driving action of the drive unit 18, the first and second clamp arms 14, 16 can be rotated at a substantially constant force. Thus, from start of rotation of the first and second clamp arms 14, 16 until the rotational operation thereof is completed, the second frame W2 is pressed toward the first frame W1 and the workpiece W is clamped at all times by a constant clamping force.

On the other hand, in the event that the clamped state of the workpiece W by the first and second clamp arms 14, 16 is to be released, under switching operation of the non-illustrated switching device, the pressure fluid that was supplied simultaneously to the second and third ports 58, 60 is once again supplied to the first port 56. Consequently, under a pressing action of the pressure fluid, the first and second pistons 44, 46 are displaced in directions to separate away from each other, whereupon the first and second piston rods 48, 50 and the knuckle joints 74 are displaced integrally therewith.

In addition, by displacement of the knuckle joints 74 away from the cylinder tube 42, the second link pins 76 descend along the link grooves 82, and accordingly the other ends of the power-boost levers 78 are pulled about the support pins 86 to approach the drive unit 18. As a result, the gripping portions 34 of the first and second clamp arms 14, 16 are rotated via the arm pins 30 in directions to separate away from each other, whereby as shown in FIG. 3, an unclamped state is brought about in which clamping of the workpiece W is released.

In the foregoing manner, according to the present embodiment, in the clamp apparatus 10 equipped with the drive unit 18 having the pair of first and second pistons 44, 46, the driving force, which is output upon displacement of the first and second pistons 44, 46, is transmitted to the first and second clamp arms 14, 16 through the knuckle joints 74, the power-boost levers 78, and the link arms 38. In each of the power-boost levers 78, the length (third distance L3) of the one end side connected to the knuckle joint 74 with respect to the support pin 86 is set to be longer than the length (fourth distance L4) of the other end side connected to the link arm 38 with respect to the support pin 86. Thus, when the workpiece W is clamped, the driving force is boosted in power by the length ratio (L3/L4), whereby the thus-increased driving force can be transmitted to the link arms 38.

Further, in each of the first and second clamp arms 14, 16, the length (second distance L2) from the arm pin 30 to one end side connected to the link arm 38 is longer than the length (first distance L1) from the arm pin 30 to the gripping portion 34 on the other end side. Thus, the driving force can be boosted by the length ratio (L2/L1) and effect rotation of the first and second clamp arms 14, 16 to thereby clamp the workpiece W.

As a result, although the driving force output by the drive unit 18 is small, since the workpiece W can be clamped at a desired clamping force by boosting the driving force, even in the case that, for example, a large clamping force is required, a drive unit 18 that produces a small output force can be used, and the clamp apparatus 10 can be made smaller in scale.

Furthermore, the second and third ports 58, 60 to which the pressure fluid is supplied are provided respectively on one end and the other end of the cylinder tube 42 that constitutes the drive unit 18, and by supplying the pressure fluid with respect to the second and third ports 58, 60, the first and second pistons 44, 46 are displaced in directions to approach one another mutually, whereby the first and second clamp arms 14, 16 can be rotated to bring about a clamped condition. As a result, for example, using a speed control valve or the like, by making the supplied amount of pressure fluid that is supplied to the second port 58 different from the supplied amount of pressure fluid that is supplied to the third port 60, the rotational speed of the first clamp arm 14 and the rotational speed of the second clamp arm 16 can be changed.

For example, if the amount of pressure fluid supplied to the second port 58 is large, whereas the amount of pressure fluid supplied to the third port 60 is small, then the rotational speed of the first clamp arm 14 can be made faster, and the rotational speed of the second clamp arm 16 can be delayed or made slower with respect to the rotational speed of the first clamp arm 14. Owing thereto, the gripping portion 34 of only the first clamp arm 14 is brought into abutment first against the workpiece W in order to position the workpiece W, and thereafter, the gripping portion 34 of the second clamp arm 16 is later brought into abutment against the workpiece W to clamp the workpiece W between the first and second clamp arms 14, 16. Consequently, in the clamp apparatus 10, the workpiece W can be clamped reliably at a predetermined position without the need of performing a positioning operation of the workpiece W separately, and therefore, efficiency of clamping operation can be improved.

On the other hand, the driving force transmission mechanism 20 of the aforementioned clamp apparatus 10 is not limited to the case shown in FIGS. 4A through 4C, in which the knuckle joints 74 are connected to the other ends of the first piston rod 48 (and the second piston rod 50), and the power-boost levers 78 are disposed rotatably through the second link pins 76 in the link grooves 82 of the knuckle joints 74. For example, in a driving force transmission mechanism 100 shown in FIGS. 5A through 5C, connecting pins 102, which are connected to the other ends of the first piston rod 48 (and the second piston rod 50), may be inserted through grooves 106 formed on one end side of the power boost levers (transmission levers) 104, whereby the power-boost levers 104 are connected rotatably with respect to the first piston rod 48 (and the second piston rod 50).

Figures 5A, 5B, 5C:
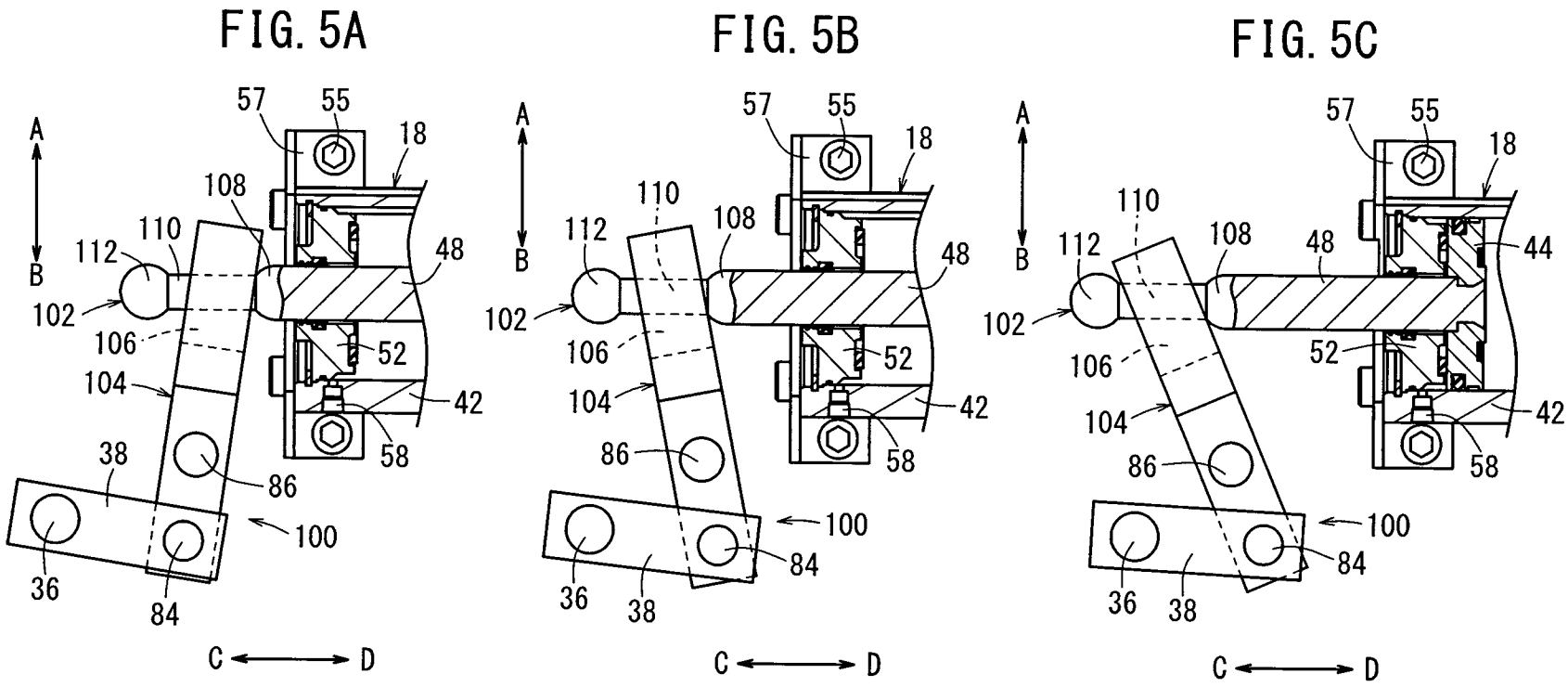
FIGS. 5A through 5C are operational views for describing operations of a driving force transmission mechanism according to a modification.

In FIGS. 5A through 5C, one connecting pin 102 attached to the first piston rod 48, and one power-boost lever 104, to which the one connecting pin 102 is connected, are shown. However, another connecting pin 102 of the same shape also is attached to the second piston rod 50, and another power-boost lever 104 is provided, to which the other connecting pin 102 is connected, the other power boost lever 104 being arranged symmetrically with respect to the one power boost lever 104 on the first piston rod 48.

The connecting pin 102 includes a connector (engagement portion) 108 to which the piston rod 48, 50 is connected, a narrow shaft portion (shaft portion) 110 which is reduced in diameter in comparison to the connector 108, and a spherical projection (engagement portion) 112 disposed on the end of the narrow shaft portion 110. In addition, the narrow shaft portion 110, which has a predetermined length in the axial direction (the direction of arrows C and D), is inserted through the groove 106 of the power-boost lever 104, and the connector 108 and the projection 112 are installed externally of the groove 106. Further, the groove 106 opens in an extending fashion on one end of the power-boost lever 104, and the connector 108 is formed with substantially the same diameter as both of the first and second piston rods 48, 50.

More specifically, the connecting pin 102 is maintained in a state with the narrow shaft portion 110 thereof inserted in the groove 106, by the connector 108 and the projection 112, which are formed with diameters greater than the width dimension of the groove 106.

Moreover, the connecting pin 102 is not limited to a case of being connected to the first and second piston rods 48, 50, but may be formed integrally with the other ends of the first and second piston rods 48, 50.

In addition, as shown in FIG. 5A, in a clamped condition in which the workpiece W is clamped by the first and second clamp arms 14, 16, the first piston rod 48 is displaced to the side of the cylinder tube 42 (in the direction of the arrow D) upon displacement of the first piston 44, whereby the connecting pin 102 also is displaced toward the cylinder tube 42, and accordingly the one end of the power-boost lever 104 is pulled by the projection 112 and displaced to the side of the drive unit 18. Consequently, the other end side of the power-boost lever 104 is rotated through the support pin 86 in a direction (the direction of the arrow C) away from the drive unit 18, whereupon the one end of the first clamp arm 14 (as well as the second clamp arm 16) is pressed via the link arm 38, and the gripping portion 34 of the first clamp arm 14 (as well as that of the second clamp arm 16) is rotated in a direction to approach and thereby clamp the workpiece W and bring about a clamped state.

On the other hand, in the event that the aforementioned clamped state is released to bring about an unclamped state, under a driving operation of the drive unit 18, the first piston rod 48 is displaced in a direction to separate away from the cylinder tube 42, whereby as shown in FIGS. 5B and 5C, the one end of the power-boost lever 104 is pressed by the connector 108 of the connecting pin 102, and by rotation about the support pin 86, the one end of the first clamp arm 14 is pulled via the link arm 38 toward the drive unit 18 (in the direction of the arrow D). Consequently, an unclamped state is brought about in which the gripping portion 34 of the first clamp arm 14 is rotated in a direction away from the workpiece W (see FIG. 5C).

Further, in the event that the condition is to be changed from the aforementioned unclamped state once again into the clamped state of the workpiece W, under a driving action of the drive unit 18, the first piston rod 48 is displaced to become accommodated in the cylinder tube 42, whereby the projection 112 of the connecting pin 102 comes into abutment against the side surface of the power-boost lever 104 and pulls the power-boost lever 104 toward the cylinder tube 42 (in the direction of the arrow D). Accordingly, the power-boost lever 104 is rotated about the support pin 86, and the link arm 38 is pushed out in a direction away from the drive unit 18. As a result, the one end of the first clamp arm 14 is displaced in a direction to separate away from the drive unit 18, and then the gripping portion 34 of the first clamp arm 14 is rotated toward the workpiece W to thereby grip the workpiece W in the clamped state.

More specifically, in the case that the first and second clamp arms 14, 16 are moved from a clamped state into an unclamped state, the ends of the power-boost levers 104 are pressed by the connectors 108 of the connecting pins 102, whereby the power-boost levers 104 are rotated, while conversely, in the case that the first and second clamp arms 14, 16 are moved from an unclamped state into a clamped state, the ends of the power-boost levers 104 are pulled by the projections 112 of the connecting pins 102, whereby the power-boost levers 104 are rotated.

Accordingly, through implementation of the above-described driving force transmission mechanism 100, simply by inserting the narrow shaft portions 110 of the connecting pins 102, which are connected to the other ends of the first and second piston rods 48, 50, with respect to the grooves 106 of the power-boost levers 104, the driving force transmission mechanism 100 can easily be assembled, and therefore, the number of assembly steps needed to assemble the driving force transmission mechanism 100 can be reduced.

The clamp apparatus according to the present invention is not limited to the above embodiment. Various changes and modifications may be made to the embodiment without departing from the scope of the invention as set forth in the appended claims.

The invention claimed is:

1. A clamp apparatus for rotating a pair of clamp arms to a clamping position and thereby clamping a workpiece between the clamp arms, comprising:

a body;

a drive unit disposed on the body and including displaceable members that are displaceable along an axial direction;

a pair of clamp arms supported rotatably with respect to the body, the clamp arms being directly and rotatably attached to the body, and the clamp arms having gripping portions defined by a respective end of each of the clamp arms, and disposed in confronting relation to each other to clamp a workpiece; and a driving force transmission mechanism including:

transmission levers, each of the transmission levers being supported rotatably with respect to the body at a support pivot axis, and each of the transmission levers having a first end pivotally connected to one of the displaceable members, and link arms, each of the link arms having one end pivotally connected to one of the clamp arms at a clamp arm pivot axis and a second end pivotally connected to a second end of a respective transmission lever at a link arm pivot axis, wherein each respective transmission lever connects a respective one of the displaceable members with a respective one of the clamp arms via a respective one of said link arms, to transmit a driving force along the axial direction of the drive unit to the respective clamp arm and thereby to rotate the respective one of the clamp arms such that the clamp arms rotate to the clamping position while the gripping portions approach one another, wherein a distance from the support pivot axis to the first end of each respective transmission lever in a longitudinal direction of each respective transmission lever is longer than a distance from the support pivot axis to the second end of each respective transmission lever in the longitudinal direction of each respective transmission lever, the first and second ends of each respective transmission lever being opposite ends in the longitudinal direction of each of the transmission levers, and the respective support pivot axes being disposed between the first and second ends of each respective transmission lever, wherein the clamp arms, link arms and transmission levers are arranged such that, when the clamp arms are rotated to the clamping position, a line connecting the support pivot axis and the link arm pivot axis of a respective transmission lever is perpendicular to a line connecting the link arm pivot axis to the clamp arm pivot axis of the link arm pivotally connected to the respective transmission lever, and wherein the support pivot axis of each of the respective transmission levers is located, in a direction perpendicular to the axial direction, between the respective link arm pivot axes and the displaceable members.

2. The clamp apparatus according to claim 1, wherein each of the clamp arms is disposed rotatably via a respective support shaft with respect to the body, and a distance from one end of the clamp arms, to which the link arm is connected, to the support shaft in a direction perpendicular to the axial direction is longer than a distance from the gripping portion that grips the workpiece, to the support shaft.

3. The clamp apparatus according to claim 1, wherein the drive unit comprises a fluid pressure cylinder having first and second ports to which a pressure fluid is supplied, the cylinder having a cylinder main body in which the displaceable members are disposed, the displaceable members comprising a pair of pistons, wherein by the supply of the pressure fluid through the first port, the pistons are displaced in directions to separate away from each other mutually, and by the supply of the pressure fluid through the second ports, the pistons are displaced in directions to approach each other mutually.

4. The clamp apparatus according to claim 1, wherein the driving force transmission mechanism includes joint members connected to respective ends of the displaceable members, and each of the joint members has a link groove which extends in a direction perpendicular to the axial direction, a pin disposed on the first end of each of the transmission levers, the pin being displaceably inserted through the respective link groove, wherein the respective pin is located at an end of the respective link groove when the clamp arms are rotated to the clamping position.

5. The clamp apparatus according to claim 1, wherein the driving force transmission mechanism includes shaft portions, each of which is disposed on an end of a respective one of the displaceable members and is inserted through a respective groove formed on the first end of each of the transmission levers, and engagement portions which have a greater diameter with respect to a diameter of the shaft portions are respectively formed on each of the shaft portions, wherein each of the shaft portions is located at an end of the respective groove when the clamp arms are rotated to the clamping position.

6. The clamp apparatus according to claim 1, wherein when the displaceable members are displaced outward along the axial direction, the clamp arms are moved away from each other.

* * * * *